United States Patent [19]

Durazzani

[11] Patent Number: 4,794,661

[45] Date of Patent: Jan. 3, 1989

[54] PROCESS FOR THE TREATMENT OF LAUNDRY IN A WASHING MACHINE

[75] Inventor: Piero Durazzani, Pordenone, Italy

[73] Assignee: Zanussi Elettrodomestici S.p.A., Pordenone, Italy

[21] Appl. No.: 22,871

[22] Filed: Mar. 6, 1987

[30] Foreign Application Priority Data

Mar. 11, 1986 [IT] Italy ..... 45708 A/86

[51] Int. Cl.[4] ..... D06F 21/04

[52] U.S. Cl. ..... 8/158; 8/159; 68/58

[58] Field of Search ..... 8/158, 159; 68/12 R, 68/24, 58

[56] References Cited

U.S. PATENT DOCUMENTS 2,914,935 12/1959 Sampsel ..... 68/12 R
3,197,980 8/1965 Marple ..... 68/12 R

FOREIGN PATENT DOCUMENTS 234908 5/1911 Fed. Rep. of Germany .
1410985 11/1968 Fed. Rep. of Germany .
2245532 3/1974 Fed. Rep. of Germany .
982765 3/1949 France .
1126858 6/1955 France .
2066878 8/1971 France .
2525645 10/1983 France .
2074612 11/1981 United Kingdom ..... 8/159

*Primary Examiner*—Philip R. Coe
*Attorney, Agent, or Firm*—Wenderoth, Lind & Ponack

[57] ABSTRACT

A process for treatment of laundry in a basket rotatably mounted in a tub of a washing machine by actuating a valve to introduce water into the tub from a hot water supply until the tub is partially filled so as to soak the laundry contained in the basket, rotating the basket first at low speed and in alternate directions for a predetermined period of time and then at high speed in a single direction for a predetermined period of time while simultaneously recirculating water from a collector below the basket back into the basket during rotation thereof, and discharging the liquid contained in the basket after rotation of the basket is stopped. The method of the present invention allows preheating of the laundry in the basket, the basket and the tub such that it is not necessary to reheat the washing liquid during a subsequent washing program.

10 Claims, 2 Drawing Sheets

PROCESS FOR THE TREATMENT OF LAUNDRY IN A WASHING MACHINE

BACKGROUND OF THE INVENTION

The present invention relates to a process for the treatment of laundry in a washing machine, more particularly of the type in which the laundry is sprinkled with a washing liquid and also relates to a washer which operates on the basis of such a method.

At present, conventional laundry washing machines comprise a collector mounted beneath the wash tub and in fluid communication therewith for receiving the washing liquid from the wash tub, an electric recirculation pump connected to the collector and to an upper portion of the tub, the electric pump being operable to bring about a repeated recirculation of the washing liquid passed through the tub and into the collector and back to the tub by sprinkling or rinsing the liquid onto the laundry contained in a basket mounted in the tub.

More particularly, U.S. patent application Ser. No. 677,302, filed Dec. 3, 1984 (now U.S. Pat. No. 4,580,421) discloses a laundry washing machine which includes a washing tub, a laundry containing drum and a collector for the washing liquid which is positioned beneath and connected to the washing tub, the collector being so shaped as to contain at least a filtering element, an electric heating element and a thermostatic sensor for respectively filtering, heating and sensing the temperature of the washing liquid.

The washing liquid collector is connected both with outlet piping of the washing machine through a usual drain pipe, and with the wash tub through a further piping system and an electric circulating pump, which can be either separate from or on the same axis with the drain pump, the electric circulating pump being provided with a suction opening connected with the wash liquid collector as well as a delivery opening connected with the further piping system.

Such a machine performs both "intensive" and "delicate" washing programs of a traditional type for washing heavily soiled clothes at normal levels of wash liquid in the tub, while keeping the circulating pump switched off for the entire duration of such washing programs, as well as "intensive" washing programs for laundering not so heavily soiled clothes at lower levels of the washing liquid in the tub and switching on the circulating pump during certain periods during such washing programs in such a way that the washing liquid is repeatedly circulated from the collector into the tub through the piping system and is directly sprayed onto the clothes.

In particular, these special "intensive" washing programs are used to wash not so heavily soiled cottons and/or heat-resistant synthetics by filling the washing liquid into the collector at different reduced levels according to the actual wash load in the drum. The "intensive" washing programs are carried out by heating the washing liquid at predetermined temperatures with values up to no more than about 90° C., turning on the heating element, and thermostatic control of the heating element is carried out by the thermostatic sensor. This type of washing machine has proven to be satisfactory and reliable during operation and is advantageously set up for connection to a water supply system in order not to fill the tub with the desired quantity of water, together with detergents, to thereby insure the proper development of the washing programs described above.

However, this washer has drawbacks when the element for heating the washing liquid must be eliminated, such as when regulations do not permit the use of such heating elements. In such cases, the washer must therefore be connected to preexisting centralized plants in which the water of the water supply system is preheated by suitable water heaters or similar devices.

Under such conditions, the water is heated at relatively elevated temperatures on the order of about 60° C. but the water is partially cooled upon coming into contact with the laundry, the metal parts of the basket, and with the wash tub, all of which are at temperatures lower than that of the incoming water. As a result, the water introduced into the tub is cooled to a temperature lower than that required and the washing programs for the washer in which the water is recirculated cannot be carried out satisfactorily.

SUMMARY OF THE INVENTION

An object of the present invention is to overcome the drawbacks mentioned above for recirculation-type washer by means of a process for treating laundry which is effective to carry out the washing programs under conditions in which the washer is connected to a hot water supply but which does not include a heating element.

The objects of the present invention are achieved by providing a control means for the washing machine which enables the proper development of the inventive process for treating the laundry in question.

These and other objects are achieved by using a washing machine according to the present invention in which the washer is connected to a supply of hot water and the washer includes a wash tub, a basket rotatably mounted in the tub, a collector mounted beneath the tub and in fluid communication therewith for receiving the washing liquid which passes through the tub and at least one electric pump connected to the collector and to the upper portion of the tub in order to recirculate washing liquid repeatedly from the collector back into the tub.

The process of the present invention is characterized in that, prior to the start of any washing program, the tub is partially filled with hot water which may be occasionally mixed with cold water but without adding detergents such that the tub is filled to a level sufficient to bring about the soaking of the laundry in the basket and thereafter the basket is set in motion for predetermined periods of time at a lower washing speed with alternating directions of rotation and then the basket is rotated in one direction at a high centrifuging speed at the same time the electric recirculation pump is turned on, after which the rotation of the basket is stopped and the water present in the tub is discharged from the washer.

BRIEF DESCRIPTION OF THE DRAWINGS

Other objects, features and advantages of the invention will become more apparent from the following description, serving merely as a non-limiting example, with reference to the accompanying drawings, wherein.

DETAILED DESCRIPTION OF THE INVENTION

Figure 1:
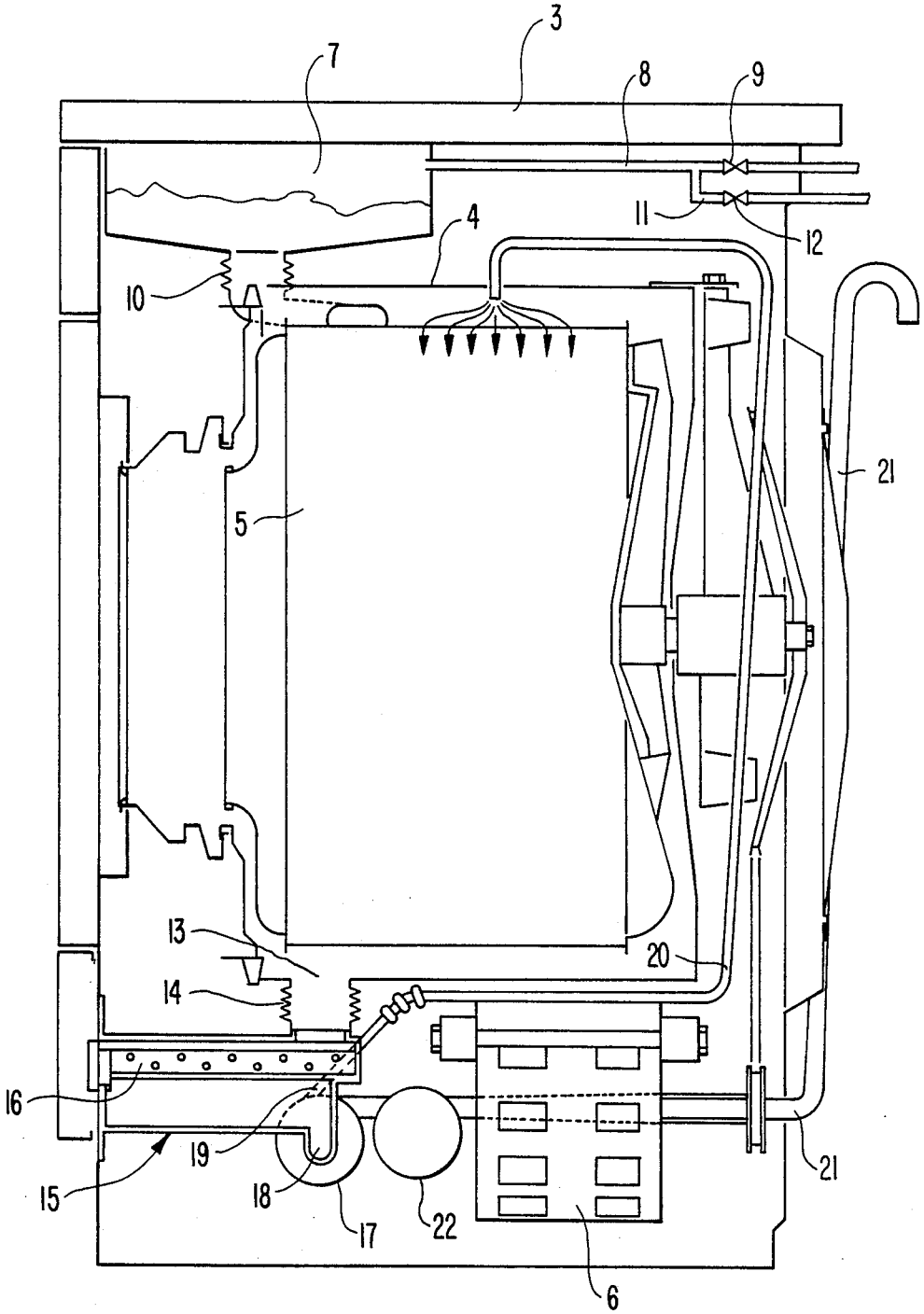
FIG. 1 is a diagrammatic and partially sectional side view of a laundry washing machine which is capable of treating laundry and which utilizes the method of the present invention.

With reference to FIG. 1, a laundry washing machine shown therein comprises a housing 3, a washing tub 4 supported within the housing 3 in a per se known manner, and a drum or basket 5 provided with a shaft mounted in suitable bearings in a hub member of a support bracket secured to a wall of the tub 4. The basket is adapted to be rotated by a motor 6 which is connected to the basket by suitable means in a conventional manner.

Disposed within the upper portion of the machine is a receptacle 7 for detergents to be used during a washing cycle connected to a water supply circuit by means of a conduit 8. The conduit 8 is connected to a supply of hot water and cold water by suitable electrically actuated valves 9 and 12, respectively.

The lower portion of the tub 4 is formed with an outlet opening 13 connected by a flexible conduit 14 to a collector 15 provided for collecting therein washing liquid issuing or discharged from the tub 4. The collector 15 is designed to accommodate a filter 16 which can comprise a fine mesh sieve or any other suitable type of a conventional filter element which is removably inserted into the collector 15. The filter 16 is disposed in the collector 15 in such a manner that the washing liquid issuing from the tub 4 passes therethrough so as to remove any particulate impurities entrained in the liquid during the execution of a laundering cycle.

The collector 15 is connected to a suction inlet 18 of a recirculation pump 17 and an outlet 19 of the recirculation pump 17 is connected by means of a conduit 20 which has a discharged end in fluid communication with a top portion of the wash tub 4 for sprinkling or rinsing the laundry contained within the tub 4. Thus, washing liquid can be recirculated repeatedly from the collector to the tub when the recirculated pump 17 is in operation.

The collector 15 is also connected to a flexible discharge conduit 21 and a dischagre pump 22 located along the flexible discharge conduit 21 is provided for discharging the washing liquid from the wash tub 4. Thus, the washer of the present invention is essentially similar to that described in U.S. Pat. No. 4,580,421 except that the washer of the present invention does not include the heating element and the thermostatic sensor of the aforesaid patent. Also, the washer of the present invention includes an electrically actuated valve 9 connected to a supply of hot water and an electrically actuated valve 12 connected to a supply of cold water, each of which can be selectively actuated to supply either hot water or a mixture of hot and cold water during preset time intervals while hot water is being supplied to the tub.

Figure 2:
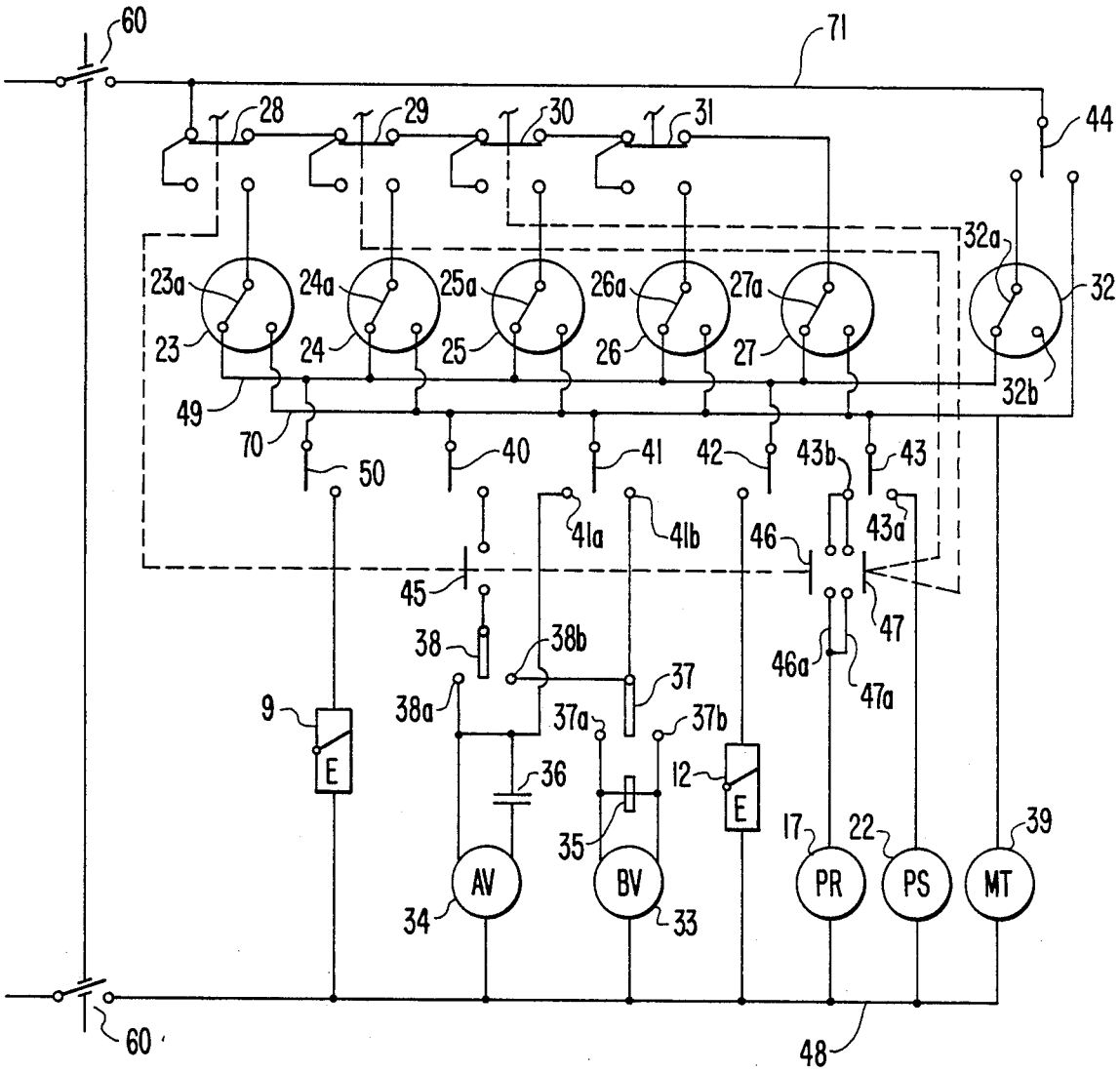
FIG. 2 shows the electrical circuit diagram for the washer of the present invention.

With reference now to FIG. 2, there is shown an electric circuit of the washing machine and which is connected to a main electric circuit via a main switch 60 and includes a first group of pressure sensors of similar level sensing devices formed by three pressostats or sensors 23, 24 and 25 adapted to control the washing liquid level during "intense" or "heavy" laundering programs for washing not too heavily soiled cotton fabrics or synthetic fabrics resistant to elevated temperatures, and a second group of pressure sensors or similar level sensing devices, shown here as comprising two pressostats or sensors 26 and 27 for controlling the washing liquid level during "intense" laundering programs for washing heavily soiled cotton fabrics or synthetic fabrics resistant to elevated temperatures. Such pressostats or sensors advantageously may be replaced by a smaller number of per se known pressostats each of which is capable of being calibrated to different water levels in the tub. In particular, the pressostats or sensors 23, 24 and 25 of the first group are calibrated to control the washing liquid charged in tub 4 at different levels so as to insure efficient laundering of different sized charges of laundry loaded into the basket. The basket may be selectively loaded with a maximum charge of laundry, with half the maximum charge or with a quarter of the maximum charge or charges of intermediate magnitude may also be used with the washing machine according to the present invention.

The described pressostats or sensors are effective to control the admission of reduced volumes of water into the tub compared to the amount of water admitted to the tub of a conventional laundry washing machine for carrying out an "intense" or "heavy" laundering program. In contrast to the conventional "intense" laundering programs, the reduction of the amount of washing liquid admitted to the tub is made possible by repeatedly recirculating the liquid from collector 15 to hub 4 (FIG. 1) by actuating recirculation pump 17 during predetermined phases of the operation cycle as will be described.

The pressostats or sensors 26 or 27 of the second group likewise are calibrated to control the amount of water admitted to the tub at different levels depending on the amount of laundry loaded into the basket. In the particular example described above, the invention provides the possibility of loading the basket with a full charge or a half charge of laundry, charges of intermediate magnitude being also possible within the scope of the invention. In these cases, the pressostats or sensors are effective to admit the same volumes of water to the washing tub as required for carrying out the respective "intense" laundering programs in conventional laundry washing machines. Each of these laundering programs is otherwise carried out in the conventional manner, i.e. without actuating the recirculation pump.

The sensors 23, 24 and 25 of the first group are provided with respective electric contacts *23a*, *24a* and *25a* adapted to be switched from the positions shown in FIG. 2 and corresponding to an "empty" operating position at which a "zero" level of washing liquid is contained within the tub, in which case all of the described contacts are electrically connected to a common conductor 49, to operative positions corresponding to respective filling levels of the washing liquid in the tub, in which each of the described contacts is electrically connected to a common conductor 70. The described contacts are additionally associated with respective manually operable switches 28, 29 and 30 adapted to be switched from first positions shown in FIG. 2, at which all of the described switches are electrically connected in series with one another to main switch 60 through a supply conductor 71, to second positions at which each of the described switches is electrically connected to the contact of the associated pressostat 23, 24 and 25, respectively.

In an analogous manner, the sensors 26 and 27 of the second group are provided with respective electric contacts *26a*, *27a* adapted to be switched between operative positions corresponding to the ones described above so as to be electrically connected to conductor 49 or conductor 70, respectively. In this case, however, only sensor 26 is associated with a switch 31 adapted to be switched from a first position shown in FIG. 2, at which it is electrically connected in series to the preceding switch 30 when the latter is in its position shown in FIG. 2, to a second position at which it is electrically connected to the contact 26*a* of the associated sensor. Contact 27*a* of the remaining sensor 27 is connected in series directly to switch 31 when the latter is in its operative position shown in FIG. 2.

The electric circuit of the machine further includes an additional sensor 32 or similar level sensing device calibrated to a level of the washing liquid in the tub different from that to which the other sensors are calibrated for controlling the washing liquid level during conventional "gentle" washing programs for washing delicate synthetic fabrics and/or woolens. As in the case of conventional laundry washing machines, a movable contact 32*a* of sensor 32 may be supplied with current from conductor 71 via a switch 44 cooperating with a cam of the program unit or programmer of the machine and adapted to be switched to a second operative position in which it is electrically connected to conductor 70 only, movable contact 32*a* being adapted to be switched between two operative positions in contact respectively with conductor 49 and with a fixed contact 32*b* of the sensor 32, fixed contact 32*b* not being connected to any further conductor.

Common conductor 49 is connected, via a further movable contact 42 cooperating with a cam of the program unit of the machine and via the above mentioned solenoid valve 12, to another supply conductor 48 connected to main switch 60. The other common conductor 70 similarly is connected to further movable contacts 50, 40, 41 and 43 cooperating with respective cams of the program unit for energizing and de-energizing the remaining electric components of the machine as described in the following.

In particular, contact 50 is operable to close a circuit including electrically actuated valve 9 connected to supply conductor 48. The movable contact 50 thus effects the supply of hot water into conduit 8 in accordance with the program unit of the washing machine of the present invention as will be described in more detail hereinafter.

Movable contact 41 is adapted to be switched to close a fixed contact 41*a* for connecting supply conductor 48 to a high-speed winding 34 of motor 6 in a spinning phase associated with a starting capacitor 36 connected in parallel to winding 34, or to close a fixed contact 41*b* connected to an inverter switch 37. The latter is intermittently actuated by a further cam of the program unit for closing respective contacts 37*a* and 37*b* of a low-speed winding 33 of motor 6, winding 33 likewise being provided with a starter capacitor 35 and connected to supply conductor 48. As a result of the operation of inverter switch 37, motor 6 is adapted to rotate in alternating directions at the washing speed.

The respective high-speed and low-speed windings 34 and 33 may also be connected to supply conductor 48 via contact 40, itself adapted to be connected in series to a further switch 45 and a second inverter switch 38 associated with a respective cam of the program unit. In particular, switch 45 is mechanically connected to switch 28 and to a further switch 46, the function of which will be described in the following, so that actuation of switch 28 to one of its operative positions thereof causes switches 45 and 46 to be simultaneously actuated between different positions. Inverter switch 38 is operable to close affixed contact 38*a* connected to high-speed winding 34 or a second fixed contact 38*b* connected to the above mentioned inverter switch 37. In practice, high-speed and low-speed windings 34 and 33, respectively, are energized via contact 41 for carrying out "intense" and "gentle" laundering programs with the normal level of the washing liquid in the tub, and via contact 40 for carrying out "intense" laundering programs with reduced levels of the washing liquid in the tub.

Contact 43 is adapted to close a fixed contact 43*a* connected to supply conductor 48 in series with the motor of the discharge pump 22, or a second fixed contact 43*b* connected to conductor 48 in series with the motor of recirculation pump 17 and with two circuit branches 46*a* and 47*a* disposed in parallel with each other and including respectively the above mentioned switch 46 and a further switch 47. Switch 47 is mechanically connected to both of the above described switches 29 and 30, so that actuation of either thereof causes switch 47 to be simultaneously actuated between different operative positions thereof.

The electric circuit shown in FIG. 2 further includes a motor 39 of the program unit directly connected between common conductor 70 and supply conductor 48.

The following description is of various laundering programs which the laundry washing machine according to the invention is capable of executing.

For laundering heavily soiled cotton fabrics and/or synthetic fabrics capable of withstanding elevated temperatures, the machine is adjustable to carry out conventional "intense" laundering programs with the possibility of loading the washing basket with a full charge of laundry or one half of a full charge. In the first case the washing program is carried out by filling the tub with washing liquid up to a level determined by controller or sensor 27 which is activated by maintaining switches 28, 29, 30 and 31 in their first operative positions shown in FIG. 2. In the second case, the washing program is carried out by filling the tub with the washing liquid to a reduced level determined by controller sensor 26 which is activated by maintaining switches 28, 29 and 30 in their first operative positions shown in FIG. 2 and actuating switch 31 to its second operative position. During these laundering programs, the washing liquid is supplied through the conduit 8 and the washing basket is rotated at the washing speed in alternating directions of rotation, and at the spinning speed in only one direction, by energizing the respective windings 33 and 34 of motor 6 only via contact 41 and inverter switch 37. The motor of the recirculation pump 17 is not energized, as the two switches 46 and 47 remain in their open positions shown in FIG. 2.

In a similar manner, "gentle" laundering programs for washing delicate synthetic fabrics and/or woolens are carried out in the conventional fashion by activating sensor 32 calibrated to a higher level of the washing liquid in the tub than the remaining sensors of the machine.

The described machine additionally is capable of carrying out "intense" laundering programs for washing less heavily soiled cotton fabrics and/or synthetic fabrics capable of withstanding elevated temperatures, employing reduced washing liquid charges in the tub and offering the possiblity of loading the basket with a full charge, half a full charge or a quarter of a full charge of laundry. The amounts of water admitted to the tub of each of these "intense" laundering programs are adjusted so as to ensure that the laundry is completely soaked in each case for efficient laundering in a manner to be described. For carrying out these "intense" laundering programs, a selected one of switches 28, 29 or 30 is actuated to its second operative position, the selection of the respective switch depending on the amount of laundry loaded into the basket, and resulting in the activation of the associated controller or sensor 23, 24 or 25, respectively.

In particular, if a full charge of laundry has been loaded into the basket, the respective program is selected by actuating switch 28 for activating sensor 23, while the remaining switches are maintained in their first operative positions shown in FIG. 2. As a result of this operation, the two switches 45 and 46 mechanically connected to switch 28 are likewise actuated to their closed positions. In this manner the respective windings 33 and 34 of motor 6 of the machine are predisposed to be energized solely via contact 40 and inverter switches 38 and 37, while the motor of the recirculation pump 17 is predisposed to be energized via contact 43 and circuit branch 46a. This laundering program is then carried out by rotating the basket at the washing speed in alternating directions of rotation, and at the spinning speed in only one direction, for shorter periods of time than in the case previously described.

During this program, recirculation pump 17 is also continually actuated so as to draw the washing liquid from collector 15 and recirculate it to tub 4 via conduit 20 by spraying it onto the laundry. As a result, the laundry remains always soaked in the washing liquid for the duration of the laundering process and is thereby protected from damage during the rotation of the basket. As the washing liquid is thus recirculated, it is caused to pass through filter 16 which is effective to retain any dirt particles so as to prevent them from soiling the laundry again and from interfering with the operation of recirculation pump 17 and the discharge pump 22. The filter is subsequently extracted from its seat for cleaning purposes when so required. The laundering of the laundry in the described manner does not provide for the washing liquid to be discharged. Only at the end of the laundering process will the washing liquid be discharged, followed by a number of rinsing operations in the conventional manner.

The "intense" laundering program for washing a one half size charge of laundry is selected by activating sensor 24 through operation of switch 29, while the remaining switches are maintained at their first operative positions shown in FIG. 2. As a result, switch 47 mechanically connected to switch 29 is simultaneously closed. In this manner the motor of recirculation pump 17 is predisposed to be energized via contact 43 and circuit branch 47*a*. The respective windings 34 and 33 of motor 6 are predisposed to be energized exclusively via contact 41 and inverter switch 37. This program is then carried out substantially in the same manner as described above.

The "intense" laundering program for washing a quarter of a full charge of laundry is initiated by activating sensor 25 through operation of switch 30 while maintaining the remaining switches in their respective first operative positions shown in FIG. 2. As a result, switch 47 is again actuated to its closed state as in the preceding case. In this manner, the motor of recirculation pump 17 and windings 34 and 33 of motor 6 are predisposed to be energized in the manner described above. For the remainder, this program is carried out substantially in the same manner as the preceding programs.

The laundry washing machine according to the invention thus is capable of washing laundry by the application either of conventional "intense" and "gentle" laundering programs or of "intense" laundering programs employing a reduced level of washing liquid in the washing tub. These latter programs particularly permit the consumption of reduced amounts of water, detergents and electric energy in comparison with conventional "intense" laundering programs. The consumption of detergents is additionally limited due to the fact that any amounts of the detergents deposited in collector 15 are completely recuperated during recirculation of the washing liquid to the tub.

The washer of the present invention is essentially similar to that described in U.S. Pat. No. 4,580,421 except that the washer of the present invention does not include the heating element and thermostatic sensor of the aforesaid patent. Instead, the washing machine of the present invention includes a conduit 8 connected to a hot water supply and a cold water supply by means of electrically actuated valves 9 and 12, respectively. With this arrangement, the washer of the present invention is connected directly to a supply of hot water, which is sprayed into the tub 4 at relatively high temperatures on the order of about 60° C. Since the temperature of the hot water is reduced upon contacting the laundry contained in the basket 5 and the metal parts of the basket and of the tub 4, it is impossible to develop satisfactory washing programs. Therefore, according to the present invention, the laundry is subjected to a treating process prior to the development of any washing program.

According to the present invention, the tub 4 is filled partially with hot water without the addition of detergents to a level so as to bring about the complete soaking of laundry which has been previously introduced into the basket 5. Next, the basket is set in motion during predetermined periods of time at a low washing speed, with alternating directions of rotation followed by rotation at a high centrifuging speed with a single direction of rotation and simultaneously, the electric recirculation pump 17 is activated to cause hot water to circulate from the collector 15 to the tub 4. In this way, the hot water introduced into the tub 4 of the washer is effective to preheat the laundry and the metal parts of the basket and of the tub, prior to the development of any actual washing program such that the desired water temperature can be obtained during the selected washing program. As such, hot water introduced into the tub for development of the selected washing program will not be cooled upon coming into contact with the laundry, the walls of the basket and with the tub, whereby it is possible to effectively run the washing programs at the predetermined temperatures.

The method of the present invention is carried out by the programmer of the washing machine, which is effective to control the electrically actuated valves 9 and 12, the motor 6, the recirculating pump 17, and the discharge pump 22. Thus, at the end of the predetermined periods of time during which the basket is rotated in alternating directions at low washing speed and after completion of the rotation of the basket at high centrifuging speed in a single direction of rotation with simultaneous recirculation of water from the collector 15 to the tub 4, the programmer is effective to terminate the recirculation of hot water and begin the discharge of the water from the washer by activating the discharge pump 22. Finally, the motor 6 of the washer is stopped and the washer is ready for development of the selected washing program with the laundry and the metal parts of the basket and tub preheated so that the desired water temperature can be maintained during the selected washing program.

As mentioned earlier, the electric circuit of the present invention includes the electrically actuated valve 9 for supplying hot water to the washer, the electric valve being electrically connected between the feed conductor 48 at the common conductor 49, the electric valve 9 being actuated by means of the electric contact 50 of the programmer. The common conductor 49 is selectively connected to respective sliding contacts of the pressure switches 23–27, which are shown in the "empty" operating position at which the tub is empty or filled with a liquid level which is lower than that predetermined by the calibration of the pressure switches. In the initial phase of the process according to the present invention, the electric valve 9 (which replaces the heating element and thermostatic sensor disclosed in U.S. Pat. No. 4,580,421) is turned on by the washer's programmer in order to enable the introduction of hot water into the wash tub, without the addition of detergents, with the reduced water level predetermined selectively by one of the pressure switches 23–25 of the first series such that the laundry contained in the basket is completely soaked. If it is necessary to introduce hot water at a temperature lower than that of the hot water supply, the programmer also actuates the electrically operated valve 12 to introduce cold water into the conduit 8 whereby the cold water and hot water are mixed in the tub to preheat the laundry to a desired temperature. Upon attaining the present level of hot water in the tub, the sliding contact of the selected pressure switch is switched to its second operating position, thereby turning off electric valve 9 and the programmer actuates the low speed windings 33 of the motor 6 via inverter 37 and the electric recirculation pump 17 is activated to begin recirculation of hot water. Consequently, the supply of hot water is stopped and the wahser's motor is driven at the low washing speed, with alternating directions of rotation, and with simultaneous repeated recirculation of hot water from the collector 15 to the tub 4. After a predetermined period of time and with the electric recirculation pump 17 remaining activated, the programer deactivates the low speed windings 33 and instead the high speed windings 34 of the motor 6 are actuated via inverter 38.

In this way, the basket is set in motion for brief intervals at the centrifuging speed, with simultaneous recirculation of hot water from the collector 15 to the tub 4. Thus, the basket 5 is set in motion in alternate directions at low speed and is rotated in one direction at high speed, for a prefixed period of time during which the laundry contained in the basket is heated to the desired temperature corresponding to the selected washing program. Finally, the programmer is effective to deactivate the electric recirculation pump 17 and activate the discharge pump 22 to cause hot water to stop circulating and instead be discharged externally from the washer.

Although the present invention has been described and illustrated with respect to preferred features thereof, it is to be understood that various modifications and changes may be made to the specifically described and illustrated features without departing from the scope of the present invention.

I claim:

1. A process for treatment of laundry in a basket rotatably mounted in a tub of a washing machine prior to the start of a washing program comprising:

introducing water into the tub from a hot water supply located externally from and connected to the washing machine until the tub is partially filled with the water so as to soak the laundry contained in the basket;

rotating the basket; and recirculating the water in the washing machine to preheat the laundry in the basket, the basket and the tub of the washer, said steps of introducing water into the tub, rotating the basket and recirculating the water being performed without introducing detergent into the tub and being performed prior to the start of a washing program whereby the temperature of the water used in a subsequent washing program can be maintained at a desired temperature since the water introduced for the selected washing program will not be cooled to an undesirable temperature by contact with the laundry contained in the basket, the basket and the tub.

2. The process of claim 1, wherein the basket is rotated for a predetermined period of time in alternating direction at low speed.

3. The process of claim 1, wherein the basket is rotated for a predetermined period of time in a single direction at high speed.

4. The process of claim 1, wherein the basket is initially rotated for a predetermined period of time in alternating directions at low speed and then for a predetermined period of time in a single direction at high speed.

5. The process of claim 1, wherein water from a cold water supply is mixed with the water from the hot water supply during the step of partially filling the washing machine with water from the hot water supply.

6. The process of claim 5, wherein the water from the cold water supply is mixed with the hot water during preset time intervals.

7. The process of claim 1, wherein the water in the washing machine is recirculated simultaneously with rotation of the basket.

8. The process of claim 1, wherein the water in the washing machine is discharged from the washing machine after the basket is rotated for a predetermined period of time.

9. The process of claim 1, further comprising washing laundry in the tub of the washing machine by carrying out a washing program after completing said step of recirculating water in the washing machine to preheat the laundry.

10. The process of claim 1, further comprising washing laundry in the tub of the washing machine by carrying out a washing program after completing the step of recirculating water in the washing machine to preheat the laundry, the washing machine being free to any means for electrically heating water circulated therein, said steps of introducing water into the tub, rotating the basket and recirculating water in the washing machine being the only method by which the temperature of the water used in the washing program is prevented from being cooled to an undesirable temperature by contact with the laundry contained in the basket, the basket itself and the tub since the laundry in the basket, the basket and the tub are preheated by the steps introducing water into the tub, rotating the basket and recirculating the water in the washing machine

* * * * *

UNITED STATES PATENT AND TRADEMARK OFFICE

CERTIFICATE OF CORRECTION

PATENT NO. : 4,794,661

DATED : January 3, 1989

INVENTOR(S) : Piero DURAZZANI

It is certified that error appears in the above-identified patent and that said Letters Patent is hereby corrected as shown below:

On the Cover Page:

Change "[73] Assignee: Zanussi Elettrodomestici S.p.A., Pordenone, Italy"

To --[73] Assignee: Industrie Zanussi S.p.A. --.

Signed and Sealed this

Twenty-sixth Day of September, 1989

*Attest:*

*Attesting Officer*

DONALD J. QUIGG

*Commissioner of Patents and Trademarks*